US006252970B1

(12) United States Patent
Poon et al.

(10) Patent No.: US 6,252,970 B1
(45) Date of Patent: Jun. 26, 2001

(54) HEADPHONE

(75) Inventors: Boby Yun Chung Poon; Chi Keung Poon, both of Kowloon (HK)

(73) Assignee: Antonio Precise Products Manufactory Limited, Kowloon (HK)

( * ) Notice: Subject to any disclaimer, the term of this patent is extended or adjusted under 35 U.S.C. 154(b) by 0 days.

(21) Appl. No.: 09/393,675

(22) Filed: Sep. 10, 1999

(51) Int. Cl.[7] ..... H04R 25/00

(52) U.S. Cl. ..... 381/374; 181/128; 181/129; 379/430; 381/385; 381/376; 381/371

(58) Field of Search ..... 381/370, 371, 381/374–376, 309, 361, 362, 364, 367, 182, 377, 378, 379, 381, 383, 385, 390; 181/128, 129; 379/430

(56) References Cited

U.S. PATENT DOCUMENTS

| | | | | |
|---|---|---|---|---|
| D. 399,206 | | 10/1998 | Yasutomi et al. . | |
| D. 403,681 | * | 1/1999 | Lam . | |
| 1,581,882 | * | 4/1926 | Stace . | |
| 2,566,313 | * | 9/1951 | Cates . | |
| 2,686,231 | * | 8/1954 | Stevens | 381/374 |
| 2,904,640 | * | 9/1959 | Dreher | 381/375 |
| 4,453,050 | * | 6/1984 | Enokido | 179/182 R |
| 4,754,484 | * | 6/1988 | Larkin | 379/430 |
| 5,134,655 | * | 7/1992 | Jensen | 379/430 |
| 5,210,792 | | 5/1993 | Kajihara . | |
| 5,450,496 | * | 9/1995 | Burris | 381/370 |
| 5,457,751 | * | 10/1995 | Such | 381/370 |
| 6,091,832 | * | 7/2000 | Shurman . | |
| 6,097,809 | * | 8/2000 | Lucey . | |
| 6,101,260 | * | 8/2000 | Jensen | 381/381 |
| 6,104,824 | * | 8/2000 | Ito | 381/381 |
| 6,105,714 | * | 8/2000 | Lindgren | 181/135 |
| 6,123,168 | * | 9/2000 | Berg . | |
| 6,130,953 | * | 10/2000 | Wilton . | |
| 6,178,251 | * | 1/2001 | Luchs . | |

* cited by examiner

*Primary Examiner*—Curtis Kuntz
*Assistant Examiner*—Dionne N. Harvey
(74) *Attorney, Agent, or Firm*—Leydig, Voit & Mayer, Ltd.

(57) ABSTRACT

A headphone including a band for extending round the back of the neck of a user and having opposite ends, each of which is connected to the band by a swivel connection having a swivel axis. At least one speaker is connected to one end of the band by a hinge connection having a hinge axis extending substantially transversely of the swivel axes. The headphone includes a pair of hanger means provided at respective ends of the band for engaging respective ears of the user to support the overall headphone. The headphone is convertible through operation of the swivel and hinge connections between a first use configuration in which the speaker is on the left side and a second use configuration in which the speaker is on the right side.

9 Claims, 3 Drawing Sheets

HEADPHONE

The present invention relates to a headphone and, particularly but not exclusively, to a headphone including a boom microphone.

BACKGROUND OF THE INVENTION

Conventional headphones and headsets typically incorporate a headband for extending round the top of a user's head to support the headphone speakers against opposite ears of the user. The headband will inevitably disturb the user's hair, which some users will mind, and also may easily slide off from the wearing position. Although compact earphones will not disturb the user's hair, they are found to be uncomfortable or insecure to wear inside auricles and, more importantly, cannot normally support a boom microphone for use as a headset. Certain earphones are provided with an ear hook for positively engaging the user's ear, in the form of headsets as disclosed in U.S. Pat. Nos. 5,210,792 and 5,450,496, but they are designed for wearing with the boom microphone either on the left ear or on the right ear.

Recently, Sony Corporation introduced a headphone (model MDR-G61) incorporating a rear band which extends round the back of the user's neck and therefore does not disturb the hair. The band is shaped for comfortable wearing, but in a manner which does not permit swapping of the speakers between left and right.

The subject invention seeks to provide a modified headphone that avoids the aforesaid disadvantages.

SUMMARY OF THE INVENTION

According to the invention, there is provided a headphone comprising a band for extending round the back of the neck of a user and having opposite ends; each of which is connected to the band proper by means of a swivel connection having a swivel axis, at least one speaker connected to one end of the band by means of a hinge connection having a hinge axis extending substantially transversely of the swivel axes, and a pair of hanging means provided at respective ends of the band for engaging opposite ears of the user to support the overall headphone, whereby the headphone is convertible through operation of the swivel and hinge connections between a first use configuration in which the speaker is on the left side and a second use configuration in which the speaker is on the right side.

Preferably, the two hanging means are in the form of hooks provided by respective ends of the band, as separate parts from the speaker.

More preferably, each hook is substantially C-shaped.

Further more preferably, the hook adjacent to the speaker has an upper end, to which the speaker is connected in a depending manner.

In a slightly different aspect, the invention provides a headphone comprising at least one speaker, a pair of ear hooks for engaging opposite ears of a user from behind, with one of them supporting the speaker by means of a hinge connection having a hinge axis, and a band for extending round the back of the neck of the user and interconnecting the ear hooks by means of respective swivel connections having respective swivel axes extending substantially transversely of the hinge axis, whereby the headphone is convertible through operation of the hinge and swivel connections between a first use configuration in which the speaker is on the left side and a second use configuration in which the speaker is on the right side.

In either case, the speaker may have a rear housing which supports a boom microphone.

Preferably, the housing is rotatable relative to the speaker for pivoting the boom microphone.

In the first case, the headphone includes two said speakers which are connected to the opposite ends of the band in substantially the same manner.

In the second case, the headphone includes two said speakers which are supported by the respective ear hooks in substantially the same manner.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
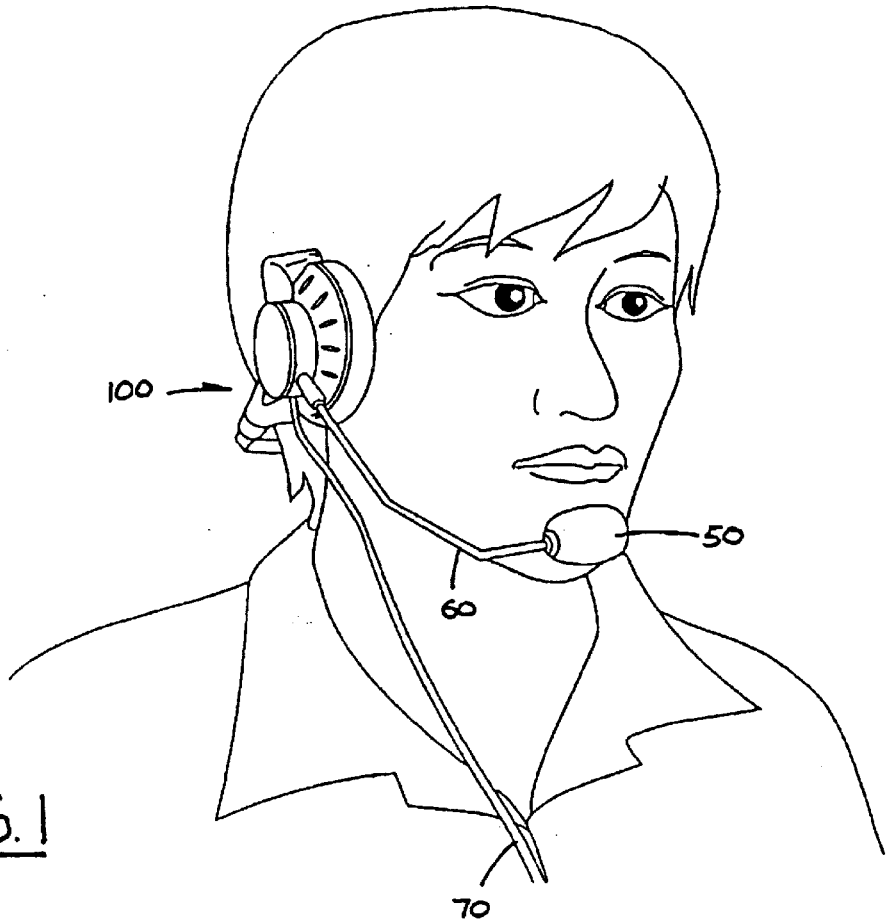
FIG. 1 is a front, right side perspective view of an embodiment of a headphone in accordance with the invention, which is worn on the head of a user to have a boom microphone on the right side.
Figure 2:
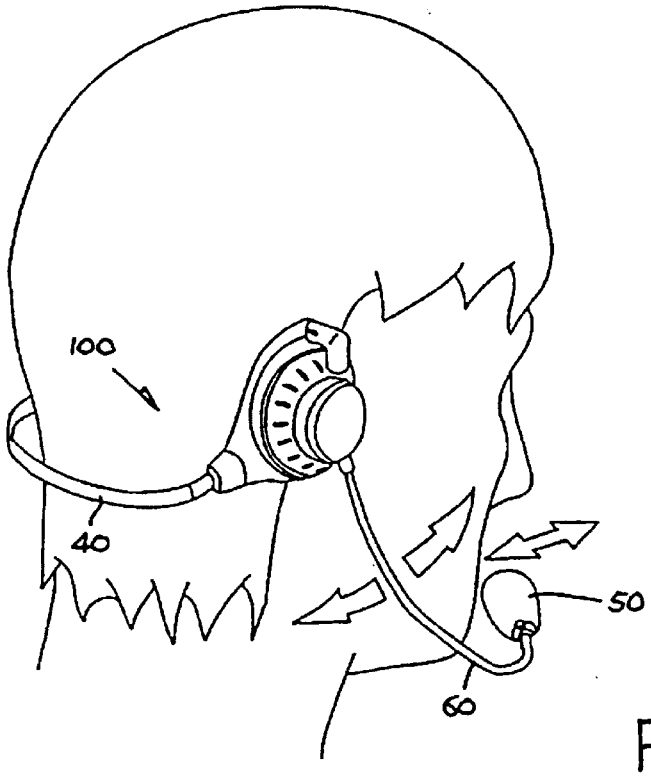
FIG. 2 is a rear, right side perspective view of the headphone of FIG. 1.
Figure 3:
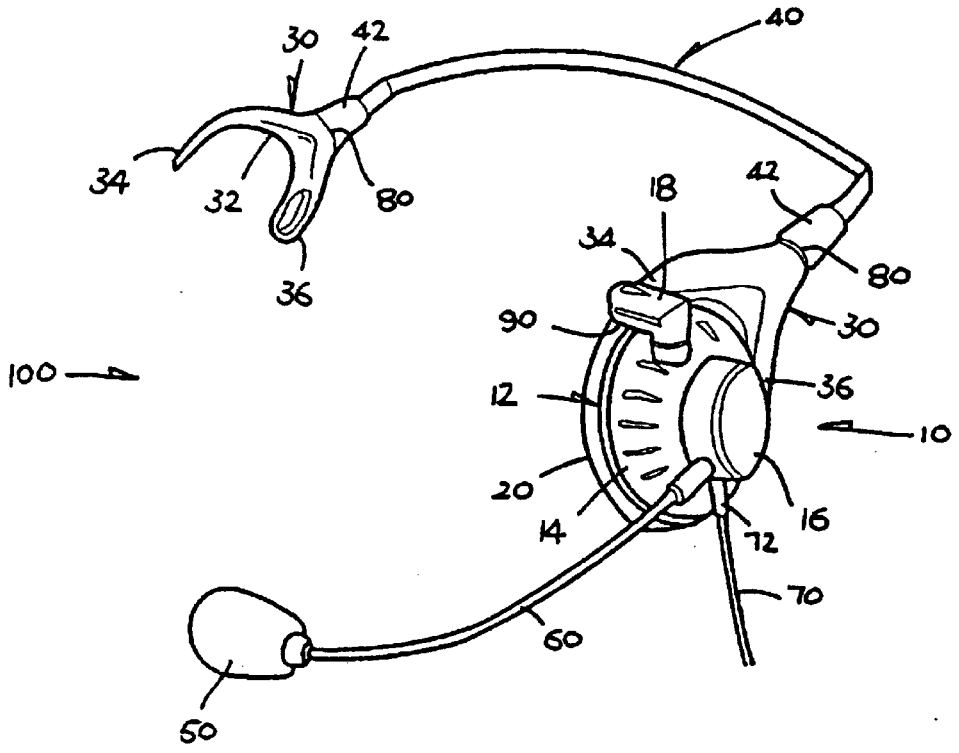
FIG. 3 is a front, left side perspective view of the headphone of FIG. 1, which has been converted into an alternative configuration for wearing with the boom microphone on the left side.

Referring initially to FIGS. 1 to 3 of the drawings, there is shown a headphone 100 embodying the invention, which headphone 100 comprises a receiver 10 incorporating a lightweight open-type speaker 20 for resting against the right ear of a user, and a pair of left and right hanging means in the form of ear hooks 30 interconnected by means of a flexible rear band 40 for engaging opposite ears of the user from behind to hold the receiver 10 in position. The headphone 100 includes a microphone 50 supported by a boom 60 extending from the receiver 10, together forming a headset 100 for telecommunication or multimedia usage.

The receiver 10 has a housing 12 containing the speaker 20, which includes, on the rear side of the speaker 20, a part-spherical body part 14 and a cylindrical central part 16 protruding from the body part 14. The central part 16 is rotatable relative to the body part 14 through an angle of about 180°, to which the microphone boom 60 is connected. The body part 14 is formed, on its upper side, with an inverted-L-shaped connector 18 and, on its lower side, with an entrance 72 for an input signal cable 70.

Each ear hook 30 has a C-shaped body 32 which provides a curved upper end 34 for bearing on the top side of the respective user's ear and a relatively shorter co-operating lower end 36. The body 32 is joined, at its back, to a respective end 42 of the band 40 by means of a swivel connection 80. The connection 80 has a horizontal swivel axis and permits the ear hook 30 to turn upside down through an angle of about 180°. The upper end 34 of the right ear hook 30 supports, in a depending manner, the receiver housing 12 by means of the connector 18 to form a hinge connection 90. The connection 90 has a vertical hinge axis and permits the receiver 10 to turn outwards or inwards through an angle of about 180°.

In use, the receiver 10 faces inwards, on the outside of the associated ear hook 30, to bear against the user's right ear, with both ear hooks 30 engaging the respective user's ears on opposite sides from behind and the band 40 extending round the back of the user's neck (or head). The band 40 is resilient for clamping onto the user's head with a light but sufficient force, whereby the ear hooks 30 are kept in engagement with the user's ears and in turn support the overall headset 100. The microphone boom 60 extends at an angle of say 45° downwards to place the microphone 50 close to the user's mouth. For this purpose, the boom 60 itself is bendable and its angle is adjustable through the rotation of the central part 16 of the receiver housing 12.

Figure 4:
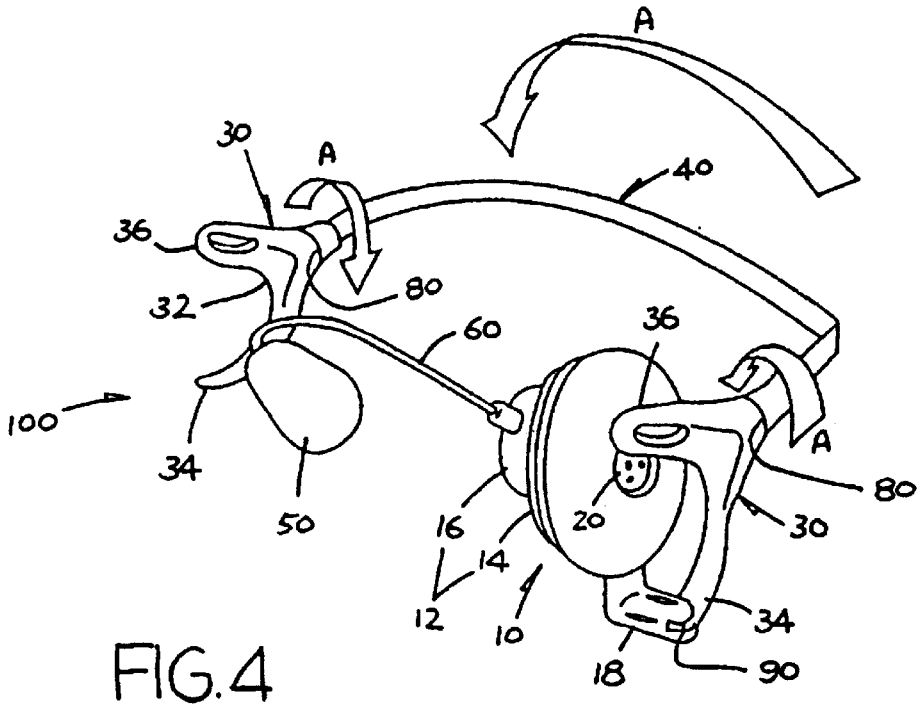
FIGS. 4, 5, 6 are perspective views illustrating sequentially how the headphone of FIG. 3 is converted back to the original configuration of FIGS. 1 and 2.
Figure 5:
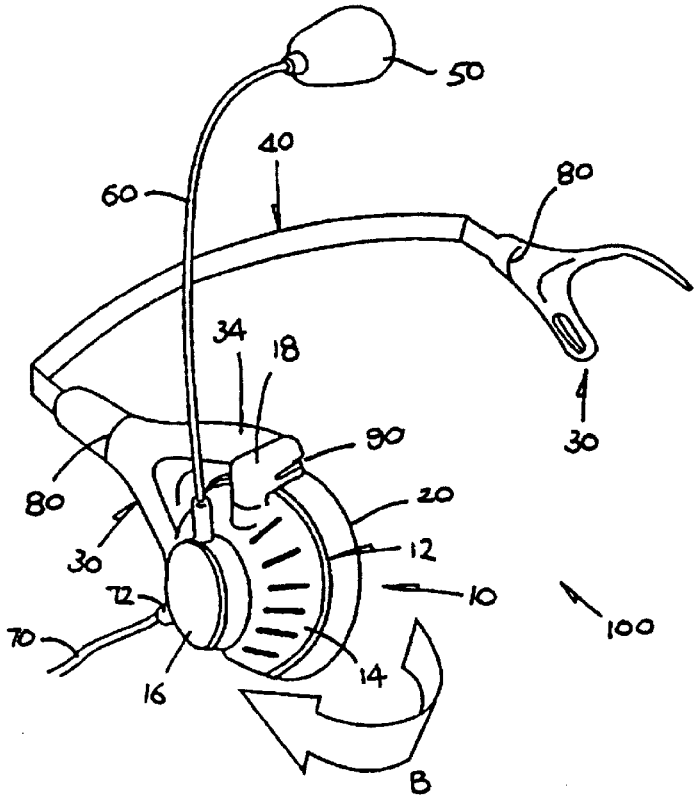
Figure 6:
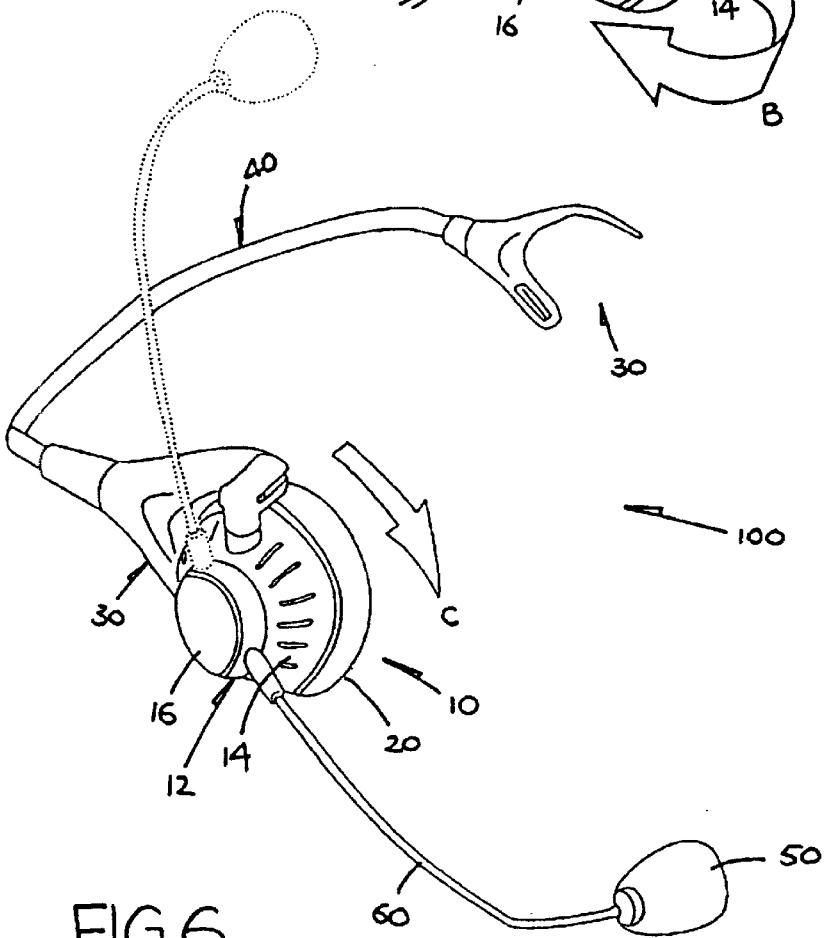

By reason of the user's personal preference or comfort and/or the blocking of eyesight, the headset 100 is convertible into an alternative configuration for wearing with the boom microphone 50 on the left side, as shown in FIG. 3. Reference is also made to FIGS. 4 to 6, which illustrate sequentially how the headset 100 of FIG. 3 is converted back to the original configuration of FIGS. 1 and 2, or vice versa.

Initially, the ear hooks 30 are turned upside down through operation of the swivel connection 80 (as indicated by arrows A in FIG. 4). The receiver 10, now facing outwards, is then turned to face inwards through operation of the hinge connection 90 (as indicated by arrow B in FIG. 5). In FIG. 5 (and also FIG. 6), the overall headset 100 has been inverted into the proper position for wearing. Finally, the central part 16 of the receiver housing 12 is rotated to pivot the microphone boom 60 downwards at a suitable angle (as indicated by arrow C in FIG. 6).

As one can see, the headset 100 is convertible from the left-sided configuration of FIG. 3 into the right-sided configuration of FIG. 6 (or FIGS. 1 and 2), or vice versa through reversed operations.

In the described embodiment, the hooks 30 at the ends of the band 40 are used for engaging the user's ears, which are separate parts from the receiver 10/speaker 20. In a different construction, the receiver 10/speaker 20 may be formed with an inturned rim for hanging onto the user's ear, with the adjacent end of the band being for connecting to the receiver 10/speaker 20 only.

It is envisaged that an additional speaker 20 may be provided on the opposite side, supported on the ear hook 30 that is free in the same manner as the receiver 10, for stereo operation. When the subject headphone is designed for listening only, the boom microphone 50 is omitted.

The invention has been given by way of example only, and various other modifications of and/or alterations to the described embodiment may be made by persons skilled in the art without departing from the scope of the invention as specified in the appended claims.

What is claimed is:

1. A headphone comprising:

a band for extending around the back of the neck of a user and having opposed first and second ends, first and second swivels respectively connected to the first and second ends of the band, the first and second swivels each having a respective swivel axis, first and second hangers connected to the first and second swivels, respectively, for engaging respective ears of the user to support the headphone, and a hinge and a speaker, the speaker being connected by the hinge to the first hanger, the hinge having a hinge axis transverse to the swivel axis of the first swivel, whereby the headphone is convertible through operation of the first and second swivels and the hinge between a first use configuration in which the speaker is on the left side and a second use configuration in which the speaker is on the right side.

2. The headphone as claimed in claim 1, wherein the first and second hangers are hooks separate from the speaker.

3. The headphone as claimed in claim 2, wherein each hook is substantially C-shaped.

4. The headphone as claimed in claim 3, wherein the hook adjacent to the speaker has an upper end, to which the speaker is connected in a depending manner.

5. The headphone as claimed in claim 1, wherein the speaker has a rear housing supporting a boom microphone.

6. The headphone as claimed in claim 5, wherein the housing is rotatable relative to the speaker for pivoting the boom microphone.

7. A headphone comprising:

at least one speaker, first and second ear hooks for engaging respective ears of a user from behind, the first ear hook including a hinge having a hinge axis and hingedly supporting the speaker, a band for extending around the back of the neck of the users, and first and second swivels having respective swivel axes transverse to the hinge axis and respectively connecting first and second ends of the band to the first and second ear hooks, whereby the headphone is convertible, through operation of the hinge and the first and second swivels between a first use configuration in which the speaker is on the left side and a second use configuration in which the speaker is on the right side.

8. The headphone as claimed in claim 7, wherein the speaker has a rear housing supporting a boom microphone.

9. The headphone as claimed in claim 8, wherein the housing is rotatable relative to the speaker for pivoting the boom microphone.

* * * * *